US007767039B2

(12) United States Patent
Kondo et al.

(10) Patent No.: US 7,767,039 B2
(45) Date of Patent: Aug. 3, 2010

(54) MARTENSITIC STAINLESS STEEL

(75) Inventors: Kunio Kondo, Sanda (JP); Hisashi Amaya, Kyoto (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/335,676

(22) Filed: Jan. 20, 2006

(65) Prior Publication Data

US 2006/0174979 A1 Aug. 10, 2006

Related U.S. Application Data

(63) Continuation of application No. PCT/JP2004/010745, filed on Jul. 22, 2004.

(30) Foreign Application Priority Data

Jul. 22, 2003 (JP) ..... 2003-277682

(51) Int. Cl.
*C22C 38/18* (2006.01)

(52) U.S. Cl. ..... 148/327; 148/542; 420/57; 420/61; 420/67

(58) Field of Classification Search ..... 148/327, 148/22, 542; *B23K 35/30*
See application file for complete search history.

(56) References Cited

U.S. PATENT DOCUMENTS 3,123,468 A 3/1964 Tanczyn

FOREIGN PATENT DOCUMENTS

| | | |
|---|---|---|
| JP | 02-243740 | 9/1990 |
| JP | 03-120337 | 5/1991 |
| JP | 05-287455 | 11/1993 |
| JP | 07-041909 | 2/1995 |
| JP | 08-041599 | 2/1996 |
| JP | 10-068050 | 3/1998 |
| JP | 10-130785 | 5/1998 |
| JP | 11-310855 | 11/1999 |
| JP | 2000-192196 | 7/2000 |
| JP | 2001179485 A * | 7/2001 |
| JP | 2002-129278 | 5/2002 |
| JP | 2002-173740 | 6/2002 |
| JP | 2002-363708 | 12/2002 |
| JP | 2003-003243 | 1/2003 |
| JP | 2003-514990 | 4/2003 |
| WO | 01/36699 | 5/2001 |

OTHER PUBLICATIONS

M. Ueda et al., "Corrosion Resistance of 13CR-5NI-2MO Martensitic Stainless Steel in $CO_2$ Environment Containing a Small Amount of $H_2S$", Corrosion 92, The NACE Annual Conference and Corrosion Show, Paper No. 55, (1992).

* cited by examiner

*Primary Examiner*—George Wyszomierski
*Assistant Examiner*—Weiping Zhu
(74) *Attorney, Agent, or Firm*—Clark & Brody

(57) ABSTRACT

A martensitic stainless steel having a resistance to sulfide stress corrosion cracking superior to Super 13 Cr steel and having a strength and corrosion resistance comparable to dual phase stainless steels has a chemical composition consisting essentially of, in mass %, C: 0.001-0.1%, Si: 0.05-1.0%, Mn: 0.05-2.0%, P: at most 0.025%, S: at most 0.010%, Cr: 11-18%, Ni: 1.5-10%, sol. Al: 0.001-0.1%, N: at most 0.1%, O: at most 0.01%, Cu: 0-5%, solid solution Mo: 3.5-7%, the composition satisfying the following Equation (1), optionally at least one element selected from at least one of the following Groups A-C, and a remainder of Fe and impurities and undissolved Mo, if undissolved Mo is present.

$$\text{Ni-bal.}=30(C+N)+0.5(Mn+Cu)+Ni+8.2-1.1(Cr+Mo+1.5Si)\geqq-4.5 \quad \text{Equation (1)}$$

Group A—W: 0.2-5%

Group B—V: 0.001-0.50%, Nb: 0.001-0.50%, Ti: 0.001-0.50%, and Zr: 0.001-0.50%

Group C—Ca: 0.0005-0.05%, Mg: 0.0005-0.05%, REM: 0.0005-0.05%, and B: 0.0001-0.01%.

4 Claims, 2 Drawing Sheets

MARTENSITIC STAINLESS STEEL

CROSS REFERENCE TO RELATED APPLICATIONS

This application is a continuation of International Patent Application No. PCT/JP2004/010745, filed Jul. 22, 2004. This PCT application was not in English as published under PCT Article 21(2).

TECHNICAL FIELD

This invention relates to a martensitic stainless steel having excellent resistance to corrosion by carbon dioxide gas and to sulfide stress corrosion cracking. The martensitic stainless steel according to the present invention is useful as a material for oil well pipes (OCTG) (oil country tubular goods) for pumping crude oil or natural gas containing carbon dioxide gas and hydrogen sulfide gas, steel pipes for flow lines or line pipe for transporting this crude oil, downhole equipment for oil wells, valves, and the like.

BACKGROUND ART

In recent years, the environments of wells for petroleum or natural gas are becoming increasingly severe, and therefore the corrosion of oil well pipes for pumping crude oil from the ground or piping used to transport crude oil without being treated to suppress corrosion is becoming a major problem.

In the past, since Cr-containing steels have good corrosion resistance, a 13Cr martensitic stainless steel (0.2% C-13% Cr) has mainly been used in oil wells for crude oil containing large amounts of carbon dioxide gas. In wells for crude oil including not only carbon dioxide gas but further including minute amounts of hydrogen sulfide, due to the high sensitivity to sulfide stress corrosion cracking of the above-mentioned 13Cr martensitic stainless steel, Super 13Cr steel, which is a low-carbon, Ni- and Mo-added steel (0.01% C-12% Cr-5 to 7% Ni-0.5 to 2.5% Mo), was developed, and the scope of application of this steel is increasing.

However, in environments in which crude oil contains still larger amounts of hydrogen sulfide, sulfide stress corrosion cracking occurs even with Super 13Cr steel, and it has been necessary to employ a dual phase stainless steel, which is a premium grade of steel. Dual phase stainless steels have the problem that cold working is necessary in order to obtain a high strength, thereby making their manufacturing costs high.

It is predicted that increasing the added amount of Mo is effective for increasing the corrosion resistance of a martensitic stainless steel to hydrogen sulfide. In fact, based on experimental data for such steels which are actually used, it is indicated that the corrosion resistance in an environment containing a minute amount of hydrogen sulfide is improved by increasing the added amount of Mo.

FIG. 4 of CORROSION 92 (1992), Paper No. 55 by M. Ueda et al. shows that the rate of corrosion in an environment containing a minute amount of hydrogen sulfide is markedly reduced and the susceptibility to sulfide stress corrosion cracking is decreased by increasing the added amount of Mo. However, it also suggests that if the added amount of Mo exceeds 2%, the effect on improving corrosion resistance has a tendency to reach a limit and that a further significant improvement cannot be obtained.

Probably due to the influence of such experimental facts, the added amount of Mo is at most about 3% in martensitic stainless steels which have been put to actual use.

In patent documents as well, there are not a small number of disclosures of martensitic stainless steels to which a large amount of Mo is added. For example, JP 02-243740A, JP 03-120337A, JP 05-287455A, JP 07-41909A, JP 08-41599A, JP 10-130785A, JP 11-310855A, and JP 2002-363708A disclose martensitic stainless steels having a high Mo content. However, in these patent documents, there are no specific embodiments in which corrosion resistance, and particularly resistance to sulfide stress corrosion cracking, is improved if the Mo content is further increased compared to existing martensitic stainless steels to which at most about 3% Mo is added. Thus, there is no disclosure in these patent documents of technology in which marked improvements in resistance, such as resistance to sulfide stress corrosion cracking, can be achieved by increasing the Mo content. Accordingly, it cannot be said that there is a disclosure in the prior art of a steel having improved resistance to sulfide stress corrosion cracking compared to existing Super 13Cr steel.

JP 2000-192196A discloses a steel with a high Mo content to which Co is further added with the object of obtaining a martensitic stainless steel having the same level of corrosion resistance as a dual phase stainless steel. In the examples, it is described that this steel exhibits the same level of corrosion resistance as a dual phase stainless steel. However, its chemical composition includes not only a high level of Mo but also contains Co, which is an element which is normally not contained in a stainless steel. Therefore, it is difficult to say that the corrosion resistance is greatly improved just by the increase in the Mo content, and it is necessary to also take into consideration the effects of Co. Co is an expensive element, and the addition of Co may possibly make a martensitic stainless steel more expensive than a dual phase stainless steel, thereby offering problems with respect to its practical application.

JP 2003-3243A discloses a steel to which a large amount of Mo is added, but which has been tempered to precipitate an intermetallic compound composed primarily of a Laves phase in order to obtain a high strength. Namely, in order to obtain the same corrosion resistance as a Super 13Cr steel and to further increase strength, the amount of added Mo is increased for the purpose of achieving precipitation strengthening. However, even if the added amount of Mo is increased, if Mo precipitates as an intermetallic compound, an improvement in corrosion resistance cannot be expected.

DISCLOSURE OF THE INVENTION

The present invention provides a martensitic stainless steel having excellent corrosion resistance in a carbon dioxide gas environment containing a minute amount of hydrogen sulfide and having superior corrosion resistance and particularly resistance to sulfide stress corrosion cracking compared to a low carbon Super 13Cr martensitic stainless steel.

The present inventors investigated the reason why the effects of the addition of Mo, which is thought to increase corrosion resistance in an environment containing hydrogen sulfide, saturate when the amount of added Mo exceeds a certain level. As a result, they found that high Mo steels tend to readily cause precipitation of intermetallic compounds, which limits the desired improvements in corrosion resistance.

They investigated in detail the effects of intermetallic compounds on corrosion resistance in high Mo martensitic stainless steels. As a result, although it is thought that intermetallic compounds themselves do not decrease corrosion resistance, it was ascertained that due to the precipitation of intermetallic compounds, the amount of Mo which is dissolved in the steel as solid solution (or the amount of solid solution Mo) decreases, and this stagnates an increase in corrosion resistance.

This is based on the experimental results which will next be explained.

Using martensitic stainless steel compositions for which the added amount of Mo was varied in the range of 0.2%-5%, a steel material (A) which was water quenched from 950° C. and then tempered by aging at 600° C. and a steel material (B) which was as-water quenched (without tempering) were prepared for each composition.

The amount of solid solution Mo in each steel material, which was determined by electrolytic extraction as described later, is shown in FIGS. 1(A) and 1(B).

FIG. 1(A) shows the results for tempered steel material (A). From this figure, it can be seen that if quenching and tempering are performed according to a typical prior art manufacturing method for high Mo martensitic steels, when the added amount of Mo increases to 3% or higher, the amount of solid solution Mo reaches a limit and does not further increases even if the added amount of Mo is further increased.

FIG. 1(B) shows the results for as-quenched steel material (B). As can be seen from this figure, as the amount of added Mo increases, the amount of solid solution Mo increases, and a steel material with a high level of solid solution Mo is achieved.

A smooth 4-point bending test was performed on a test piece of each of these steel materials in various sulfide-containing environments while a stress corresponding to the yield strength of the steel was applied to the test piece, and whether sulfide stress corrosion cracking occurred or not was examined. The results are shown in FIGS. 2(A) and 2(B). In each figure, the vertical axis shows the corrosive environment. The corrosive conditions become more severe as the height along the vertical axis increases. In the figures, the blackened circles indicate the occurrence of cracking, and the white circles indicate cases in which cracking did not occur.

FIG. 2(A) shows the resistance to sulfide stress corrosion cracking for tempered steel material (A). When the added amount of Mo is increased to 3% or higher, the corrosion resistance of the steel does not increase, and the effect of addition of Mo saturates with no further improvement in corrosion resistance.

FIG. 2(B) shows the resistance to sulfide stress corrosion cracking for as-quenched steel material (B). In contrast to FIG. 2(A), the corrosion resistance is further improved when the added amount of Mo is increased to 3% or higher.

From the results of FIGS. 1(A) and 1(B) and FIGS. 2(A) and 2(B), it becomes clear that corrosion resistance of Mo-containing martensitic stainless steels is improved depending not on the added amount of Mo but on the amount of solid solution Mo.

Accordingly, in order to improve the corrosion resistance of a currently used Super 13Cr steel, it is not sufficient merely to increase the added amount of Mo. Rather, it is necessary to increase the amount of Mo present in the steel in the form of a solid solution.

It was also found that if the amount of δ ferrite in the metallographic structure of the steel becomes too large, it becomes easy for intermetallic compounds to precipitate in the interface between the δ ferrite and martensite phases, thereby decreasing the corrosion resistance of the steel. Accordingly, in order to improve corrosion resistance with certainty by increasing the amount of solid solution Mo, it is effective to make the chemical composition such that the value of the Ni-bal., which is an indicator of the amount of δ ferrite and which is expressed by the following equation, is equal to or greater than a prescribed value.

$$\text{Ni-bal.}=30(C+N)+0.5(Mn+Cu)+Ni+8.2-1.1(Cr+Mo+1.5Si).$$

A martensitic stainless steel according to the present invention has a chemical composition consisting essentially of, in mass %, C, 0.001-0.1%, Si: 0.05-1.0%, Mn: 0.05-2.0%, P: at most 0.025%, S: at most 0.010%, Cr: 11-18%, Ni: 1.5-10%, sol. Al: 0.001-0.1%, N: at most 0.1%, O: at most 0.01%, Cu: 0-5%, solid solution Mo: 3.5-7%, the composition satisfying the below-described Equation (1), optionally at least one element selected from at least one of the following Group A, Group B, and Group C, and a remainder of Fe and impurities and undissolved Mo, if undissolved Mo is present.

$$\text{Ni-bal.}=30(C+N)+0.5(Mn+Cu)+Ni+8.2-1.1(Cr+Mo+1.5Si)\geqq-4.5 \qquad \text{Equation (1)}$$

Group A—W: 0.2-5%

Group B—V: 0.001-0.50%, Nb: 0.001-0.50%, Ti: 0.001-0.50%, and Zr: 0.001-0.50%

Group C—Ca: 0.0005-0.05%, Mg: 0.0005-0.05%, REM: 0.0005-0.05%, and B: 0.0001-0.01%

When Cu is present, the content thereof is preferably in the range of 0.1-5 mass %.

According to the present invention, a martensitic stainless steel can be provided which has a high strength and excellent toughness and corrosion resistance, and which can be used even in severe environments which exceed the limits of use of Super 13Cr steel and in which up to now it was necessary to use expensive dual phase stainless steels. This steel can even be welded, and it is suitable not only for OCTG but also for uses such as flow lines and line pipe.

DETAILED EXPLANATION OF THE INVENTION

Figure 1A:
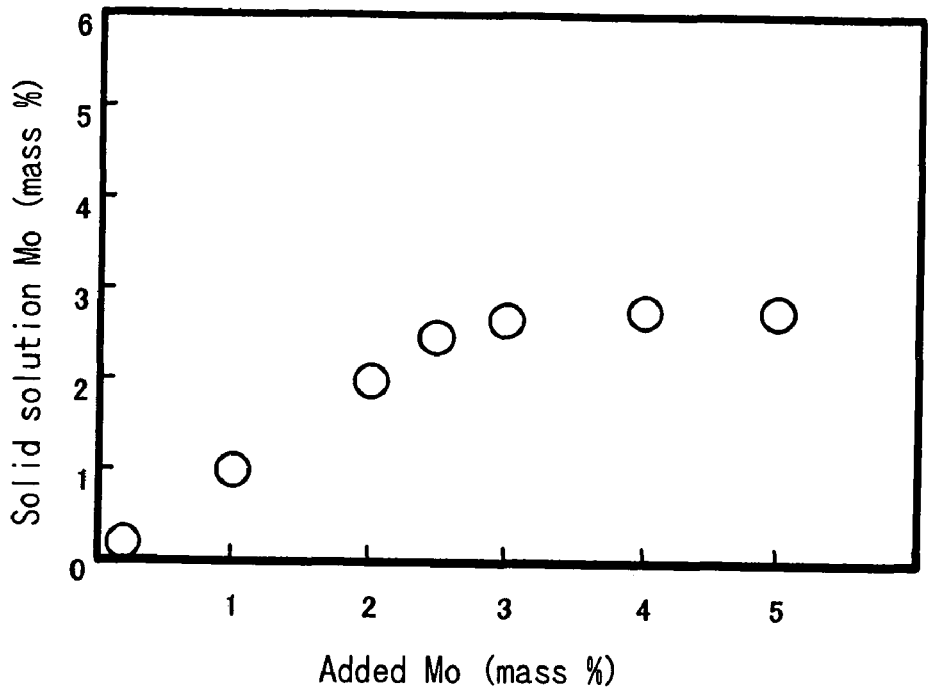
FIG. 1(A) is a graph showing the relationship between the added amount of Mo and the amount of solid solution Mo for tempered steels.

Next, the chemical composition of a martensitic stainless steel according to the present invention will be explained. In this specification, unless otherwise specified, % with respect to a chemical composition refers to mass %.

C, 0.001-0.1%

If the C content exceeds 0.1%, the hardness of steel in an as-quenched state becomes high, and its resistance to sulfide stress corrosion cracking decreases. Although the strength decreases, in order to obtain a high degree of corrosion resistance, the amount of C which is added is preferably as low as possible. However, taking into consideration economy and ease of manufacture, the lower limit is made 0.001%. A preferred C content is 0.001-0.03%.

Si: 0.05-1.0%

Si is an element which is essential for deoxidizing, but it is a ferrite-forming element. Therefore, if too much of Si is added, δ ferrite is formed, and corrosion resistance and hot workability of steel are decreased. At least 0.05% is added for deoxidizing. If Si is added in excess of 1.0%, it becomes easy for δ ferrite to form. δ ferrite decreases corrosion resistance since intermetallic compounds such as a Laves phase or a sigma phase readily precipitate in the vicinity of δ ferrite. A preferred Si content is 0.1-0.3%.

Mn: 0.05-2.0%

In steel manufacture, Mn is an essential element as a deoxidizing agent. If less than 0.05% of Mn is added, the deoxidizing action is inadequate, and toughness and corrosion resistance of steel decrease. On the other hand, if the added amount of Mn exceeds 2.0%, toughness decreases. A preferred Mn content is 0.1-0.5%.

P: at Most 0.025%

P is present in steel as an impurity and decreases corrosion resistance and toughness of steel. In order to obtain adequate corrosion resistance and toughness, the P content is made at most 0.025%, but the lower its content the better.

S: at Most 0.010%

S is also present in steel as an impurity and decreases the hot workability, corrosion resistance, and toughness of steel. In order to obtain adequate hot workability, corrosion resistance, and toughness, the S content is made at most 0.010%, but the lower its content the better.

Cr: 11-18%

Cr is an element which is effective at increasing the resistance to carbon dioxide gas corrosion of steel. Adequate resistance to carbon dioxide gas corrosion is not obtained if the Cr content is less than 11%. If the Cr content exceeds 18%, it becomes easy for δ ferrite to form, and it becomes easy for intermetallic compounds such as a Laves phase or a sigma phase to precipitate in the vicinity of the δ ferrite, thereby decreasing corrosion resistance of steel. The Cr content is preferably less than 14.5%.

Ni: 1.5-10%

Ni is added in order to suppress the formation of δ ferrite in steel of a low C, high Cr composition. If the amount of added Ni is less than 1.5%, the formation of δ ferrite cannot be suppressed. If Ni is added in excess of 10%, the Ms point of steel is decreased too much, and a large amount of retained austenite is formed, so a high strength can no longer be obtained. At the time of casting, the larger the mold size, the more easily segregation occurs, and it becomes easier for δ ferrite to form. In order to prevent this, the added amount of Ni is preferably 3-10% and more preferably 5-10%.

Solid Solution Mo: 3.5-7%

Mo is an element which is important for achieving optimal resistance to sulfide stress corrosion cracking in steel. In order to achieve good resistance to sulfide stress corrosion cracking, it is necessary not to define the added amount of Mo but to define the amount of solid solution Mo in the steel. If at least 3.5% of solid solution Mo cannot be guaranteed, a corrosion resistance of the level which is the same as or better than that of a dual phase stainless steel cannot be obtained. There is no particular restriction on the upper limit of the amount of solid solution Mo from the standpoint of performance, but from a practical standpoint, the upper limit at which Mo can be easily dissolved in steel as solid solution is 7%. The amount of solid solution Mo is preferably 4-7%, and more preferably it is 4.5-7%. There is no particular limit on the added amount of Mo, but taking into consideration costs and segregation, the upper limit of the added amount of Mo is made around 10%.

sol. Al: 0.001-0.1%

Al is an essential element for deoxidizing. The effect thereof cannot be expected with less than 0.001% of sol. Al. Al is a strong ferrite-forming element, so if the amount of sol. Al exceeds 0.1%, it becomes easy for δ ferrite to form. Preferably the amount of sol. Al is 0.005-0.03%.

N: at Most 0.1%

If the N content exceeds 0.1%, the hardness of steel becomes high, and problems such as a decrease in toughness and a decrease in resistance to sulfide stress corrosion cracking are revealed. The lower the N content, the better is the toughness and corrosion resistance, so preferably the N content is at most 0.05%, more preferably at most 0.025%, and most preferably at most 0.010%.

O (Oxygen): at Most 0.01%

If the oxygen content exceeds 0.01%, toughness and corrosion resistance of steel decrease.

Cu: 0-5%

Cu can be added when it is desired to further increase resistance to carbon dioxide gas corrosion and resistance to sulfide stress corrosion cracking of steel. In addition, it can be added when it is desired to obtain an even higher strength by subjecting the steel to aging. When Cu is added, it is necessary to add at least 0.1% in order to obtain the above-described effects. If the added amount of Cu exceeds 5%, the hot workability of steel decreases and the manufacturing yield thereof decreases. When Cu is added, the Cu content is preferably 0.5-3.5%, and more preferably 1.5-3.0%.

In addition to the above-mentioned elements, if necessary, at least one element selected from at least one of the following Group A, Group B, and Group C may be added.

Group A—W: 0.2-5%

W may be added in order to further increase resistance to localized corrosion of steel in a carbon dioxide gas environment. In order to obtain this effect, it is necessary to add at least 0.2% of W. If the W content exceeds 5%, it becomes easy for intermetallic compounds to precipitate due to the formation of δ ferrite. When W is added, the preferred content thereof is 0.5-2.5%.

Group B—V: 0.001-0.50%, Nb: 0.001-0.50%, Ti: 0.001-0.50%, and Zr: 0.001-0.50%

One or more of V, Nb, Ti, and Zr can be added to fix C and decrease variations in the strength of steel. For each one of these elements, if the amount thereof which is added is less than 0.001%, the effects thereof cannot be expected, while if any one is added in excess of 0.50%, δ ferrite forms, and corrosion resistance decreases due to the formation of intermetallic compounds in the periphery of δ ferrite. When at least one of these elements are added, the preferred content for each is 0.005-0.3%.

Group C—Ca: 0.0005-0.05%, Mg: 0.0005-0.05%, REM: 0.0005-0.05%, and B: 0.0001-0.01%

Each of Ca, Mg, REM, and B is an element which is effective at increasing the hot workability of steel. In addition, they function to prevent nozzle plugging during casting. At least one of these elements can be added when it is desired to obtain these effects. However, if the content of any one of Ca, Mg, or REM is less than 0.0005% or the content of B is less than 0.0001%, the above effects are not obtained. On the other hand, if the content of Ca, Mg, or REM exceeds 0.05%, coarse oxides are formed, and if the B content exceeds 0.01%, coarse nitrides are formed, and these oxides or nitrides serve as points from which pitting originate, thereby decreasing corrosion resistance of steel. When these elements are added, the preferred content for Ca, Mg, and REM is 0.0005-0.01%, and the preferred content for B is 0.0005-0.005%.

Determination of the Amount of Solid Solution Mo

The amount of solid solution Mo can be determined by the following procedure.

A test piece of a steel having a known amount of added Mo is subjected to electrolytic extraction in a 10% AA electrolytic solution, which is a solution in a nonaqueous solvent. The 10% AA electrolytic solution is a solution of 10% acetylacetone and 1% tetramethylammonium chloride in methanol. This electrolytic extraction acts to dissolve iron and alloying elements present in the form of solid solutions, and any intermetallic compounds remain undissolved. The amount of Mo remained in the extraction residue is then determined by an appropriate analytical method. The difference between the added amount of Mo and the amount of Mo in the extraction residue is the amount of solid solution Mo.

Manufacturing Method

There are no particular restrictions on the method of manufacturing a steel according to the present invention which contains at least 3.5% of solid solution Mo. A process which can obtain such a steel is described below as an example, but other methods can be used as long as they can ensure that it produces a steel having the necessary amount of solid solution Mo.

After a steel having a predetermined composition in which the Mo content is at least 3.5% is cast, the resulting ingot is heated at a high temperature of at least 1200° C. for at least about 1 hour before it is bloomed. This heating is performed since δ ferrite remains in segregated portions of the ingot and tends to easily form intermetallic compounds. The bloom is again heated at a high temperature of at least 1200° C. for at least about 1 hour, and then subjected to hot working such as rolling. In the case of a seamless steel pipe, the hot working steps are punching and rolling. After hot working, in order to remove the strains induced by working, the worked piece was heated and held at a temperature of at least the $Ac_3$ point of the steel, and it is then quenched by water cooling. When the resulting as-quenched steel contains a large amount of retained austenite phase and has a low strength, it may be subjected to aging heat treatment at a temperature below 500° C. at which Mo cannot diffuse in the steel.

Metallographic Structure

There are no particular restrictions on the metallographic structure of a stainless steel according to the present invention as long as it contains a martensite phase. However, from the standpoint of guaranteeing strength, a preferable metallographic structure contains at least 30 volume % of a martensite phase. The remainder may be a structure primarily comprising a retained austenite phase.

A δ ferrite phase may be present in the steel, but intermetallic compounds readily precipitate in its periphery. Therefore, it is preferable to suppress the formation of δ ferrite as much as possible. As shown by the following Equation (1), the value of the Ni-bal., which is an indicator of the amount of δ ferrite, is made to be greater than or equal to −4.5.

$$\text{Ni-bal.}=30(C+N)+0.5(Mn+Cu)+Ni+8.2-1.1(Cr+Mo+1.5Si)\geqq-4.5 \quad (1)$$

In Equation (1), the symbol for each element indicates its content in mass In the case of a steel to which Cu is not added, the value of C is set to 0. The tendency to form δ ferrite is influenced by the conditions at the time of high temperature casting of a steel. Therefore, for Mo, the added amount of Mo is plugged into the equation, regardless of the amount of solid solution Mo or precipitated Mo in the final product.

The lower the amount of δ ferrite, the better is the corrosion resistance. In this respect, the value of the Ni-bal. is preferably −3.5 or greater, more preferably it is −2.5 or greater, and most preferably it is −2 or greater.

The following examples illustrate the present invention, but the present invention is not limited to the forms shown in the examples.

EXAMPLES

Steels having the chemical compositions shown in Table 1 (the amount of Mo is the added amount) were prepared by melting and cast to form ingots. The ingots were heated for 2 hours at 1250° C., and then they were forged to prepare blocks. The blocks were heated again for 2 hours at 1250° C., and then rolled so as to prepare rolled members with a thickness of 10 mm. The rolled members were once cooled to room temperature, and then after heating for 15 minutes at 950° C., they were quenched by water cooling. A portion were left in a water-quenched state, and the remainder were then heat-treated by aging for 1 hour at 100-620° C.

In Table 1, Steels A-U are high Mo steels, Steel V is a conventional Super 13Cr steel, and Steel W is a dual phase stainless steel. Of high Mo Steels A-U, Steels T and U do not satisfy the requirements of the present invention in that the value of Ni-bal. is smaller than −4.5. Steel W, which is a dual phase stainless steel, was prepared by solution heat treatment at 1050° C. followed by cold rolling so as to have the strength indicated in Table 2.

The amount of solid solution Mo in each steel which was determined by the above-described method is shown in Table 2.

Runs Nos. 1-19 are cases of Steels A-S in which heat treatment was as forced cooling or done by low-temperature aging at 500° C. or lower, and all or nearly all the Mo which was added to the steel was dissolved as solid solution. In contrast, Runs Nos. 24-42 show cases of the same steels as above which were cooled slowly or subjected to high-temperature aging at 500° C. or higher. In these cases, the amount of solid solution Mo was significantly decreased compared to the added amount, and the addition of Mo in an increased amount could not produce a steel in which the amount of solid solution Mo was at least 3.5%.

Figure 1B:
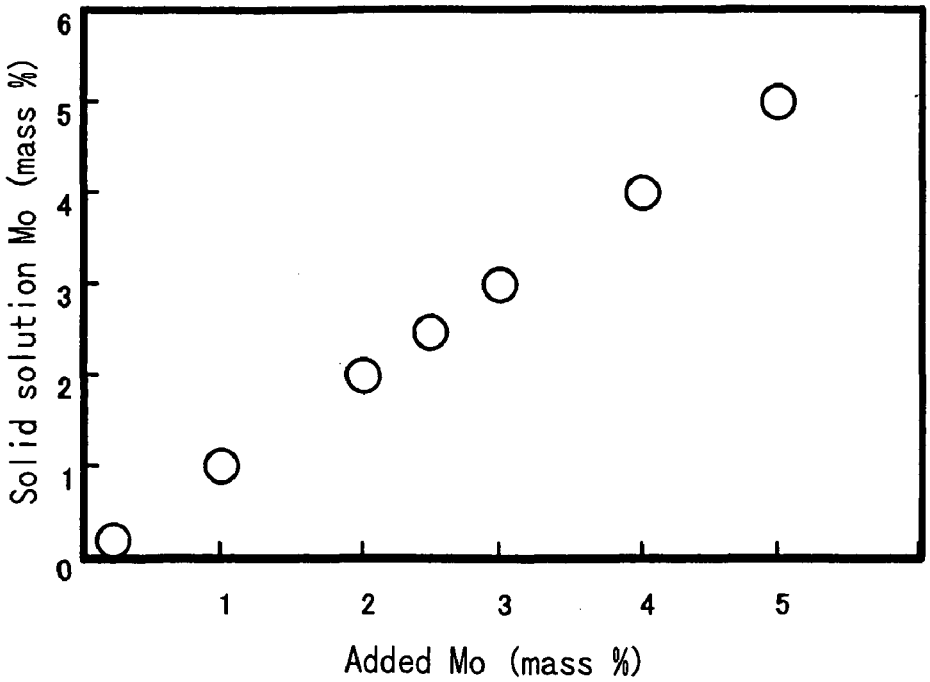
FIG. 1(B) is a graph showing the relationship between the added amount of Mo and the amount of solid solution Mo for as-quenched steels.

Runs Nos. 20-21 show cases which contained an increased amount of δ ferrite, and the amount of solid solution Mo was decreased since an intermetallic compound tends to easily deposit. Run No. 22 is a conventional case in which the amount of added Mo is 2.5% or smaller. In this case, due to a low Mo content, all the Mo which was added was dissolved as solid solution even if aging is performed at a temperature of 500° C. or higher [see FIGS. 1(A) and 1(B)].

Figure 2A:
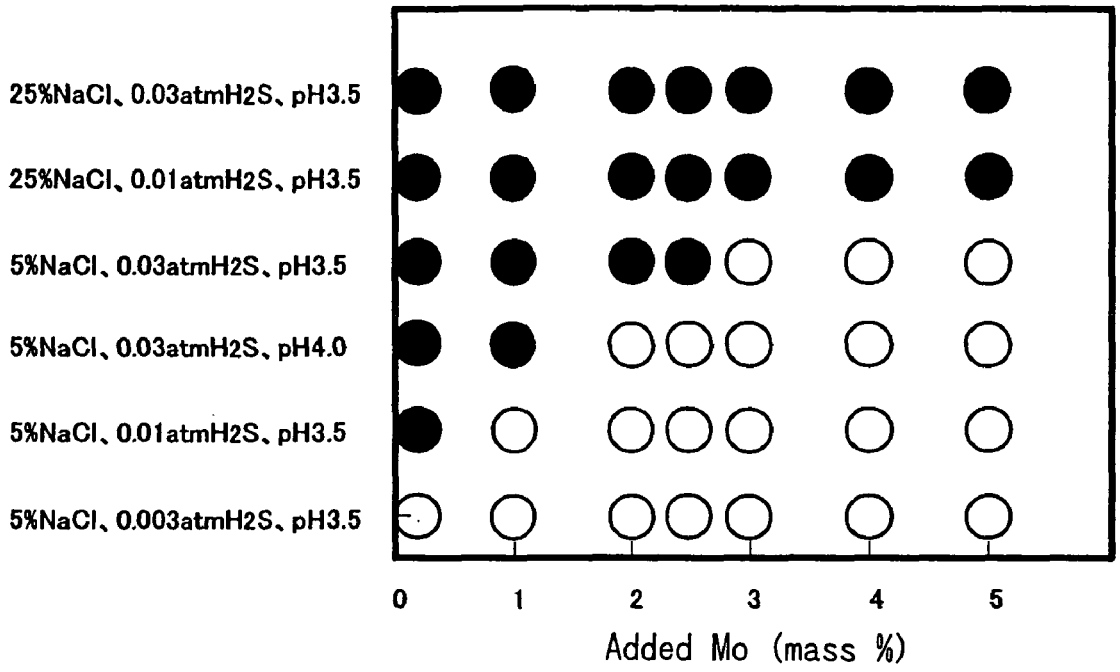
FIG. 2(A) is a graph showing the relationship between the added amount of Mo and the resistance to sulfide stress corrosion cracking in various environments for tempered steels.
Figure 2B:
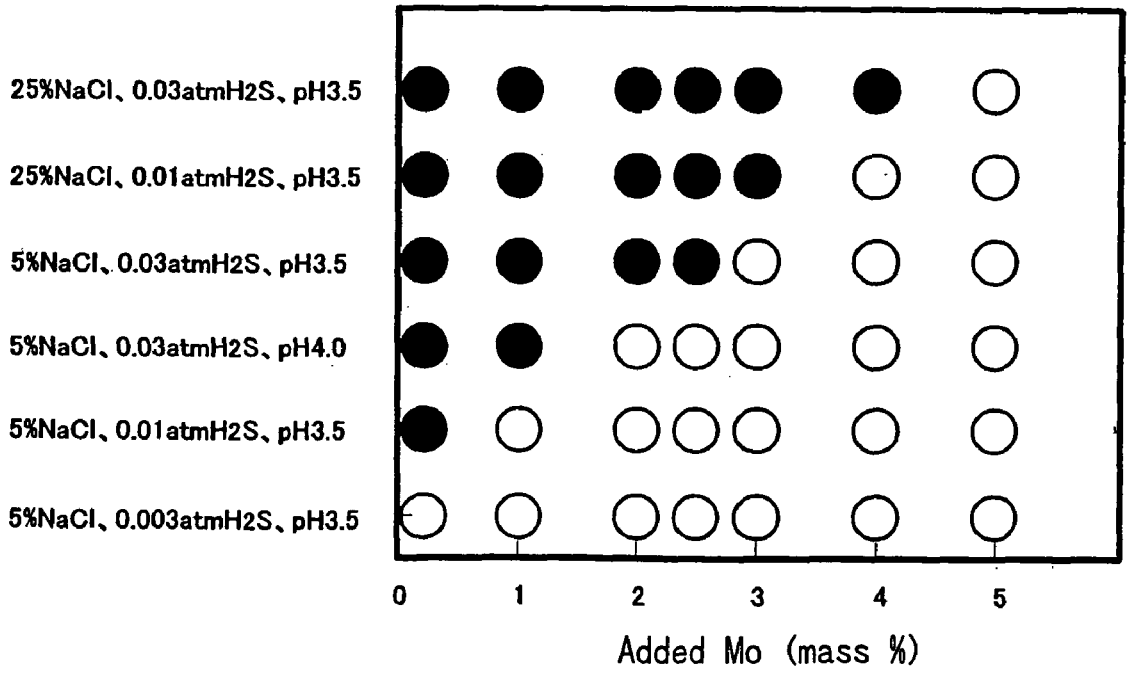
FIG. 2(B) is a graph showing the relationship between the added amount of Mo and the resistance to sulfide stress corrosion cracking in various environments of as-quenched steels.

For each steel, a tensile test was performed to evaluate its mechanical properties, and a smooth 4-point ending test was performed to evaluate its corrosion resistance. In the 4-point bending test, each test piece was set in such a manner that a bending stress corresponding to the yield stress of the steel determined by the tensile test and shown in Table 2 was applied to its surface. The bending test was performed by immersing two test pieces of each steel to be tested, which were stressed as above, for 336 hours in a test solution in the following two Environments 1 and 2 [which correspond respectively to the second and first conditions from the top in the vertical axis of FIGS. 2(A) and 2(B)], and it was determined whether there were any cracks after the test.

Environment 1: 25% NaCl, 0.01 atm $H_2S$+30 atm $CO_2$, pH 3.5

Environment 2: 25% NaCl, 0.03 atm $H_2S$+30 atm $CO_2$, pH 3.5

In Table 2, ○○ indicates that there were no cracks in either of the two test pieces, ○x indicates that there were cracks in one of the test pieces, and xx indicates that cracks developed in both test pieces.

Runs Nos. 1-19 are examples of steels in which the amount of solid solution Mo prescribed by the present invention was obtained. The value of the yield strength in the tensile test was at least 900 MPa, which is higher than that of a cold rolled dual phase stainless steel (Run No. 23). In spite of this high strength, the corrosion resistance in Environment 1 was such that no cracks were formed, and good corrosion resistance was obtained. Of these steels, the steels of Runs Nos. 3, 4, and 12-19, which contained Cu in an amount according to the present invention, exhibited good corrosion resistance even in Environment 2 which was more severe than Environment 1. For Runs Nos. 10 and 11 which did not contain Cu but which had a comparatively large amount of solid solution Mo, the corrosion resistance was slightly improved with respect to the other Cu-free steels, but it was not adequate, so it is clear that corrosion resistance can be markedly improved by both guaranteeing the amount of solid solution Mo and by adding Cu.

In Runs Nos. 20 and 21, the amount of solid solution Mo prescribed by the present invention was satisfied, but the value of the Ni-bal. was too small, so good corrosion resistance was not obtained.

Run No. 22, which is an example of a conventional Super 13Cr steel, had poor corrosion resistance. Run No. 23 is an example of a dual phase stainless steel having good corrosion resistance.

Runs Nos. 24-42 are examples in which the amount of solid solution Mo prescribed by the present invention is not satisfied. Except for the amount of solid solution Mo, the chemical compositions are the same as for Runs Nos. 1-19, respectively. Compared to the corresponding steel materials in Runs Nos. 1-19, in spite of these steels having generally a lower strength, the corrosion resistance was also decreased. Accordingly, it is apparent that guaranteeing an amount of solid solution Mo of at least 3.5% is necessary in order to markedly improve both strength and corrosion resistance.

The present invention has been described with respect to preferred embodiments thereof. It should be understood that the present invention is not limited thereto but many variation may be made within the scope of the present invention.

TABLE 1

| Steel | Chemical composition (mass %) | | | | | | | | | | | | | Value of |
|---|---|---|---|---|---|---|---|---|---|---|---|---|---|---|
| Type | C | Si | Mn | P | S | Cr | Ni | Cu | Mo | sol. Al | N | O | Others | Ni-bal.[1] |
| A | 0.025 | 0.35 | 0.69 | 0.013 | 0.001 | 12.0 | 7.8 | — | 4.7 | 0.011 | 0.005 | 0.004 | — | −1.703 |
| B | 0.041 | 0.24 | 0.61 | 0.004 | 0.001 | 11.8 | 6.9 | — | 4.8 | 0.013 | 0.007 | 0.004 | — | −1.811 |
| C | 0.010 | 0.36 | 0.21 | 0.016 | 0.001 | 11.8 | 6.2 | 3.0 | 6.5 | 0.016 | 0.002 | 0.004 | — | −4.359 |
| D | 0.035 | 0.31 | 0.13 | 0.011 | 0.001 | 12.7 | 6.9 | 1.6 | 4.4 | 0.016 | 0.013 | 0.004 | — | −1.917 |
| E | 0.036 | 0.24 | 1.09 | 0.014 | 0.001 | 12.2 | 7.1 | — | 4.8 | 0.019 | 0.006 | 0.005 | Ti: 0.011 | −1.991 |
| F | 0.019 | 0.34 | 0.59 | 0.016 | 0.001 | 12.5 | 6.5 | — | 4.2 | 0.012 | 0.005 | 0.005 | Ca: 0.0020 | −3.216 |
| G | 0.020 | 0.19 | 0.15 | 0.012 | 0.001 | 12.0 | 7.7 | — | 4.6 | 0.015 | 0.006 | 0.004 | V: 0.07, Ti: 0.047, Ca: 0.0021 | −1.819 |
| H | 0.018 | 0.71 | 0.48 | 0.015 | 0.001 | 12.4 | 6.8 | — | 4.2 | 0.015 | 0.006 | 0.003 | W: 1.2 | −3.472 |
| I | 0.018 | 0.21 | 1.11 | 0.015 | 0.001 | 11.9 | 7.7 | — | 4.1 | 0.011 | 0.005 | 0.003 | V: 0.06, Ca: 0.0015<br>Mg: 0.0011 | −0.802 |
| J | 0.006 | 0.29 | 0.55 | 0.015 | 0.001 | 11.3 | 7.2 | — | 5.8 | 0.013 | 0.001 | 0.003 | Nb: 0.018, Zr: 0.072 | −3.404 |
| K | 0.036 | 0.24 | 0.20 | 0.015 | 0.001 | 12.3 | 6.8 | — | 6.1 | 0.017 | 0.004 | 0.005 | Mg: 0.0022 | −4.336 |
| L | 0.011 | 0.24 | 1.15 | 0.015 | 0.001 | 12.0 | 7.2 | 2.2 | 4.5 | 0.018 | 0.008 | 0.004 | V: 0.05, Mg: 0.0030 | −0.901 |
| M | 0.016 | 0.21 | 0.40 | 0.012 | 0.001 | 12.1 | 7.2 | 1.7 | 5.4 | 0.016 | 0.011 | 0.002 | Ti: 0.012, Ca: 0.0008 | −2.337 |
| N | 0.032 | 0.31 | 0.57 | 0.009 | 0.001 | 12.5 | 6.0 | 1.8 | 5.1 | 0.014 | 0.005 | 0.004 | Ca: 0.0012 | −3.377 |
| O | 0.008 | 0.31 | 1.09 | 0.007 | 0.001 | 12.7 | 6.1 | 1.5 | 4.9 | 0.015 | 0.002 | 0.003 | Nb: 0.021, Ti: 0.017 | −3.977 |
| P | 0.005 | 0.31 | 0.67 | 0.015 | 0.001 | 11.5 | 6.1 | 2.3 | 4.3 | 0.017 | 0.006 | 0.004 | Ce: 0.0048 | −1.777 |
| Q | 0.012 | 0.35 | 1.08 | 0.014 | 0.001 | 13.0 | 7.5 | 1.8 | 4.2 | 0.019 | 0.002 | 0.005 | W: 0.9, V: 0.04, Ti: 0.028 | −1.938 |
| R | 0.010 | 0.25 | 0.25 | 0.009 | 0.001 | 12.2 | 6.5 | 2.0 | 5.3 | 0.019 | 0.008 | 0.003 | Ca: 0.0025 | −3.298 |
| S | 0.020 | 0.28 | 0.56 | 0.012 | 0.001 | 11.9 | 5.9 | 2.1 | 4.1 | 0.008 | 0.003 | 0.003 | Ca: 0.0016, B: 0.0011<br>Ti: 0.012 | −1.582 |
| T | 0.005 | 0.66 | 0.43 | 0.014 | 0.001 | 12.5 | 4.5 | — | 4.7 | 0.020 | 0.008 | 0.002 | V: 0.04, Ca: 0.0018 | −6.704 |
| U | 0.008 | 0.75 | 0.33 | 0.015 | 0.001 | 12.7 | 4.5 | 1.5 | 4.8 | 0.025 | 0.009 | 0.003 | V: 0.03, Ca: 0.0015 | −6.363 |
| V | 0.008 | 0.22 | 0.45 | 0.015 | 0.001 | 12.1 | 5.8 | — | 2.1 | 0.015 | 0.006 | 0.003 | V: 0.05, Ca: 0.0018 | −1.338 |
| W | 0.015 | 0.23 | 0.84 | 0.016 | 0.001 | 22.3 | 5.4 | — | 3.0 | 0.018 | 0.142 | 0.004 | — | −9.480 |

[1]Ni-bal. = 30(C + N) + 0.5(Mn + Cu) + Ni + 8.2 − 1.1(Cr + Mo + 1.5Si)

TABLE 2

| Run | Steel | Mo (mass %) | | Yield | Corrosion Resistance | | |
|---|---|---|---|---|---|---|---|
| No. | Type | Added | SS[1] | Stress (MPa) | Environ. 1 | Environ. 2 | Remark |
| 1 | A | 4.7 | 4.7 | 925 | ○○ | XX | This Invention |
| 2 | B | 4.8 | 4.4 | 981 | ○○ | XX | |
| 3 | C | 6.5 | 6.5 | 1071 | ○○ | ○○ | |
| 4 | D | 4.4 | 4.4 | 982 | ○○ | ○○ | |
| 5 | E | 4.8 | 4.2 | 901 | ○○ | XX | |
| 6 | F | 4.2 | 4.2 | 925 | ○○ | XX | |
| 7 | G | 4.6 | 4.3 | 900 | ○○ | XX | |
| 8 | H | 4.2 | 4.1 | 915 | ○○ | XX | |
| 9 | I | 4.1 | 4.0 | 922 | ○○ | XX | |
| 10 | J | 5.8 | 5.8 | 969 | ○○ | ○X | |
| 11 | K | 6.1 | 6.0 | 961 | ○○ | ○X | |
| 12 | L | 4.5 | 4.5 | 1135 | ○○ | ○○ | |
| 13 | M | 5.4 | 5.2 | 1094 | ○○ | ○○ | |
| 14 | N | 5.1 | 5.1 | 1012 | ○○ | ○○ | |
| 15 | O | 4.9 | 4.7 | 1020 | ○○ | ○○ | |
| 16 | P | 4.3 | 4.3 | 1014 | ○○ | ○○ | |

TABLE 2-continued

| Run No. | Steel Type | Mo (mass %) Added | SS[1] | Yield Stress (MPa) | Corrosion Resistance Environ. 1 | Environ. 2 | Remark |
|---|---|---|---|---|---|---|---|
| 17 | Q | 4.2 | 4.2 | 1030 | ○○ | ○○ | |
| 18 | R | 5.3 | 5.3 | 1095 | ○○ | ○○ | |
| 19 | S | 4.1 | 4.1 | 1022 | ○○ | ○○ | |
| 20 | T | 4.7 | 3.8 | 763 | XX | XX | Comparative |
| 21 | U | 4.8 | 3.7 | 775 | XX | XX | |
| 22 | V | 2.1 | 2.1 | 732 | XX | XX | Conventional |
| 23 | W | 3.0 | 3.0 | 872 | ○○ | ○○ | |
| 24 | A | 4.7 | 2.5 | 723 | XX | XX | Comparative |
| 25 | B | 4.8 | 2.2 | 763 | XX | XX | |
| 26 | C | 6.5 | 2.4 | 837 | XX | XX | |
| 27 | D | 4.4 | 2.6 | 763 | XX | XX | |
| 28 | E | 4.8 | 2.3 | 768 | XX | XX | |
| 29 | F | 4.2 | 2.5 | 774 | XX | XX | |
| 30 | G | 4.6 | 2.6 | 772 | XX | XX | |
| 31 | H | 4.2 | 2.4 | 799 | XX | XX | |
| 32 | I | 4.1 | 2.7 | 777 | XX | XX | |
| 33 | J | 5.8 | 2.6 | 774 | XX | XX | |
| 34 | K | 6.1 | 2.3 | 781 | XX | XX | |
| 35 | L | 4.5 | 2.5 | 888 | XX | XX | |
| 36 | M | 5.4 | 2.4 | 877 | XX | XX | |
| 37 | N | 5.1 | 2.6 | 803 | XX | XX | |
| 38 | O | 4.9 | 2.5 | 864 | XX | XX | |
| 39 | P | 4.3 | 2.6 | 889 | XX | XX | |
| 40 | Q | 4.2 | 2.4 | 899 | XX | XX | |
| 41 | R | 5.3 | 2.5 | 869 | XX | XX | |
| 42 | S | 4.1 | 2.4 | 865 | XX | XX | |

[1]SS = amount of solid solution Mo

The invention claimed is:

1. A martensitic stainless steel having a martensitic microstructure and consisting essentially of, in mass %, C: 0.001-0.1%, Si: 0.05-1.0%, Mn: 0.05-2.0%, P: at most 0.025%, S: at most 0.010%, Cr: 11-18%, Ni: 1.5-10%, sol. Al: 0.001-0.1%, N: at most 0.1%, O: at most 0.01%, Cu: 0-5%, solid solution Mo: 3.5-7%, W: 0-5%, V: 0-0.50%, Nb: 0-0.50%, Ti: 0-0.50%, Zr: 0-0.50%, Ca: 0-0.05%, Mg: 0-0.05%, REM: 0-0.05%, and B: 0-0.01%, the composition satisfying the following Equation (1), and a remainder of Fe and impurities and undissolved Mo, if undissolved Mo is present:

$$\text{Ni-bal.}=30(C+N)+0.5(Mn+Cu)+Ni+8.2-1.1(Cr+Mo+1.5Si)\geqq-4.359. \quad \text{Equation (1)}$$

2. A martensitic stainless steel as set forth in claim 1 wherein the chemical composition includes 0.1-5 mass % of Cu.

3. A martensitic stainless steel as set forth in claim 1 wherein the chemical composition includes, in mass %, at least one element selected from at least one of the following Groups A-C:

Group A—W: 0.2-5%

Group B—V: 0.001-0.50%, Nb: 0.001-0.50%, Ti: 0.001-0.50%, and Zr: 0.001-0.50%

Group C—Ca: 0.0005-0.05%, Mg: 0.0005-0.05%, REM: 0.0005-0.05%, and B: 0.0001-0.01%.

4. A martensitic stainless steel as set forth in claim 2 wherein the chemical composition includes, in mass %, at least one element selected from at least one of the following Groups A-C:

Group A—W: 0.2-5%

Group B—V: 0.001-0.50%, Nb: 0.001-0.50%, Ti: 0.001-0.50%, and Zr: 0.001-0.50%

Group C—Ca: 0.0005-0.05%, Mg: 0.0005-0.05%, REM: 0.0005-0.05%, and B: 0.0001-0.01%.

* * * * *